United States Patent [19]

Van Natter

[11] 3,934,909

[45] Jan. 27, 1976

[54] PUSH RELEASABLE MAGNETIC LATCH

[76] Inventor: William J. Van Natter, 18414 94th NE., Bothell, Wash. 98011

[22] Filed: July 23, 1973

[21] Appl. No.: 381,495

[52] U.S. Cl. ..... 292/251.5; 292/DIG. 4
[51] Int. Cl. ..... E05c 19/16
[58] Field of Search ..... 292/251.5, 201, DIG. 4, 292/DIG. 72

[56] References Cited

UNITED STATES PATENTS

| | | | |
|---|---|---|---|
| 256,577 | 4/1882 | Lightcap | 292/238 |
| 1,728,276 | 9/1929 | Hoyt | 292/228 |
| 2,673,111 | 3/1954 | Teetor | 292/251.5 |
| 3,492,037 | 1/1970 | Hutchinson | 292/251.5 |

*Primary Examiner*—Richard E. Moore
*Attorney, Agent, or Firm*—Seed, Berry, Vernon & Baynham

[57] ABSTRACT

A push releasable magnetic latch for cupboard doors or the like, comprising a first magnetic member secured to the cupboard door and a second magnetic member swing mounted to the cupboard structure about a pivot axis perpendicular to the path of travel of the door. The second member has a forward latching position and a rearward non-latching position, with a spring pushing the second member to its forward latching position. To open the door, the door is pushed inwardly to force the second magnetic member to its non-latching position where the two magnetic members are out of engagement, after which the door is abruptly released so that the spring causes the second member to push the door outwardly away from the cupboard structure.

12 Claims, 7 Drawing Figures

Fig. 1.
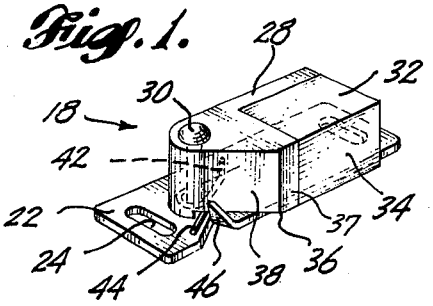
Fig. 2.
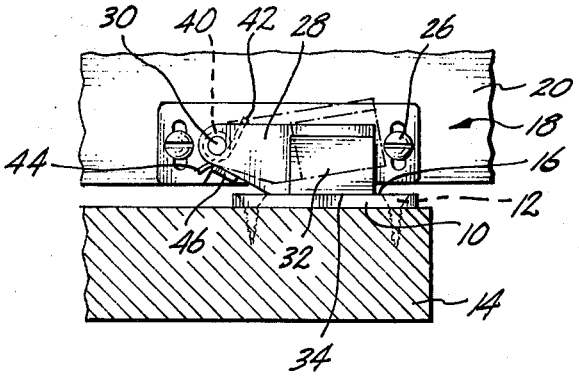
Fig. 3.
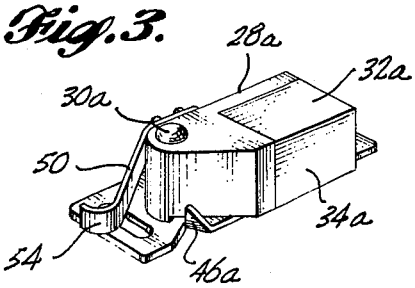
Fig. 4.
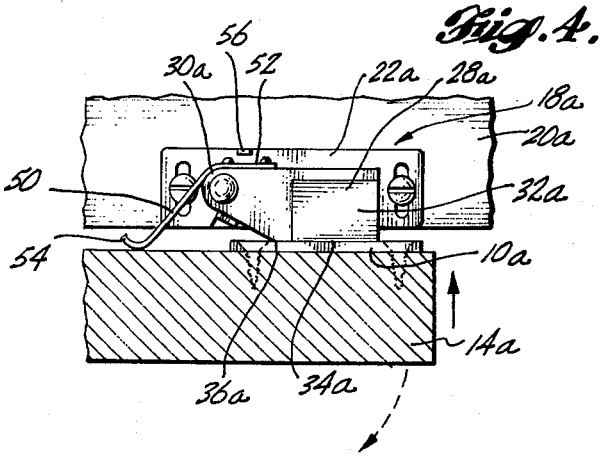
Fig. 5.
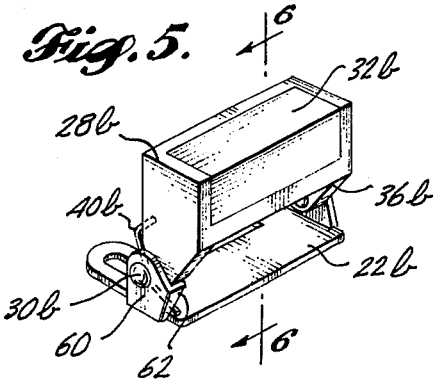
Fig. 6.
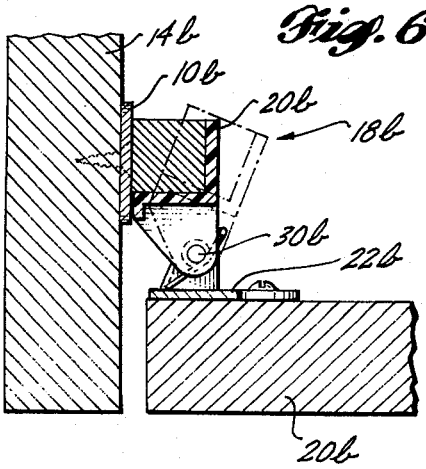
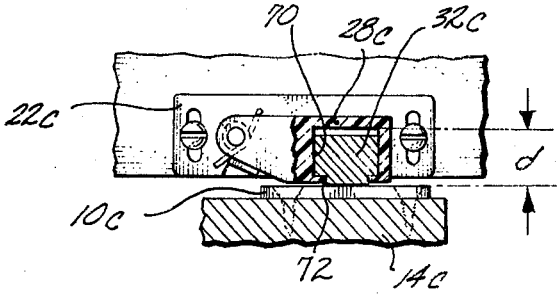
Fig. 7.

PUSH RELEASABLE MAGNETIC LATCH

BACKGROUND OF THE INVENTION

1. Field of the Invention

The present invention relates to push releasable magnetic latches, especially adapted for application to cupboard doors and the like.

2. Description of the Prior Art

There are in the prior art push releasable latches used, for example, on the cupboard doors of a household. Such devices conventionally comprise a pair of members, one mounted to the cupboard structure and the other to the door, these being so positioned that when the door is swung with moderate force to its closed position, the two elements cooperate to hold the door in its closed position. The latching assembly is so arranged that the door can be opened by pushing the door inwardly and abruptly releasing it, with a restoring force in the latch causing the door to swing away from the cupboard to its unlatched position.

U.S. Pat. No. 2,673,111, Teetor, illustrates a magnetic latch assembly wherein one magnetic element is fixedly mounted to a door, and a second latching member is swing mounted to a cupboard structure about a horizontal axis. With the door in its closed position, the second latching element hangs downwardly at its approximate natural angle of repose, with the two magnetic elements contacting each other in latching relationship. The second latching member has a spring member which is intended to perform a dual function, (a) to hold its related magnetic element in place, and (b) to provide a door releasing function by means of an upper bowed portion 47 which is to push against the door. With the door in latched position, when the door is pushed inwardly to cause its release, the second magnetic latch member is swung upwardly and rearwardly to cause the two magnetic members to disengage and also presumably to compress the spring portion 47. When the door is released, the spring portion 47 pushes the door outwardly toward its open position, but this force is in turn dependent upon the force of gravity acting to move the second member forwardly and downwardly to its normal depending position.

Other devices having various configurations of magnetic latches are shown in the following patents: Suck, U.S. Pat. No. 1,694,023; Catherall, U.S. Pat. No. 2,240,035; Ellis, U.S. Pat. No. 2,475,226; Gregory, U.S. Pat. No. 2,611,158; Teetor, U.S. Pat. No. 2,690,922; Scott et al, U.S. Pat. No. 2,888,289; Carbary, U.S. Pat. No. 2,950,139; Squire, U.S. Pat. No. 2,970,857; De Jong, U.S. Pat. No. 3,016,563; Greytok, U.S. Pat. No. 3,578,370; Waller, U.S. Pat. No. 3,635,511; Weigelt, U.S. Pat. No. 3,664,699; Page, British Pat. No. 693,564; Colombier, French Pat. No. 1,201,673 and West German Pat. No. W 15408 V/68d..

While there are prior art devices which are capable of performing the push releasable latching function as described above, there are continuing efforts to devise improved latching assemblies. Therefore it is an object of the present invention to provide a magnetic latch assembly of the push releasable type which is relatively simple and inexpensive, and yet effectively performs its latching and unlatching functions.

SUMMARY OF THE INVENTION

In the present invention, there is a first latch member comprising a first magnetic means mounted to one of the objects to be latched, such as a cupboard door. There is a second latch member comprising a second magnetic means, this second member being mounted to the other object to be latched, such as a cupboard structure, about an axis of rotation having a substantial vector component perpendicular to the path of travel to the objects toward and away from each other, which in the case of a cupboard would be the path of the door into and from its closed position. The latch member has a forward position where it is in latching relationship, and a second rearward unlatching position where the magnetic means of the second latch member is pushed out of engagement with the first magnetic means.

There is a push means on the second latch member at a location between the axis of rotation of the second latch member and its associated magnetic means. Further, there is spring means which engages the second member to urge the second member to rotate toward its forward latching position. The strength of the spring means is sufficient, relative to the attractive force between the two magnetic elements and the length and disposition of the lever arm formed by the push means acting about the axis of rotation of the second latching member, that the momentum imparted to the first object (e.g. the cupboard door) by the spring means is sufficient to cause the door to continue to travel outwardly toward its open position against the mutually attractive force of the magnetic elements. Thus the spring means acts both to move the first object and to properly position the second latch member in its latching position.

In one embodiment, there is a mounting bracket having stop means which serves to properly position the second latch member in its latching position, and also serves as an anchor for the spring means. Two variations of this are shown herein. In another embodiment, there is spring means anchored to the second latching member and also engageable with the first object (i.e. cupboard door) to impart a rotational force to the second latching member.

In accordance with another facet of the present invention, the magnetic element in the second latching member is resiliently mounted therein in a slightly recessed position. In the latching position, the second magnetic element is pulled slightly outwardly to come into close contact with the first magnetic element to provide proper latching engagement. In the release operation, it remains slightly spaced from the other magnetic element to facilitate the unlatching action. Other features of the present invention will become apparent from the following description.

BRIEF DESCRIPTION OF THE DRAWINGS

FIG. 1 is a perspective view of one of the latch members of the first embodiment of the present invention;

FIG. 2 is a top plan view of the latch assembly of the first embodiment;

FIG. 3 is a view similar to FIG. 1 of a latch member of a second embodiment of the present invention;

FIG. 4 is a top plan view of the latch assembly of the second embodiment;

FIG. 5 is a view similar to FIGS. 1 and 3 showing a third embodiment of the present invention;

FIG. 6 is a sectional view taken along line 6—6 of FIG. 5; and

FIG. 7 is a view similar to FIG. 1 showing another facet of the present invention.

DESCRIPTION OF THE PREFERRED EMBODIMENTS

In FIGS. 1 and 2, there is shown a first embodiment of the present invention, as applied to a conventional cupboard. There is a first latch member 10 mounted by screws 12 to the inner face of the outer swing end of a cupboard door 14. This first latch member 10 is simply a rectangular ferro-magnetic material having an inwardly or rearwardly directed contact surface 16.

There is a second latching member 18 mounted to a horizontal shelf 20 of the cupboard. This second member 18 comprises a mounting bracket 22 having a pair of laterally spaced slots 24 by which it is fixedly attached by screws 26 to the shelf 20, with the slots 24 permitting moderate forward or rearward adjustment of the second latch member 18.

The second latch member 18 further comprises an arm member 28 mounted for swing motion about a pin 30 fixedly attached to and upstanding from the bracket 22. The pin 30 provides an axis of rotation having a substantial vector component perpendicular to the path of travel of the door 14 toward the shelf 20 with the preferred form being that this axis of rotation be substantially perpendicular to that path of travel. A magnetic element 32 is mounted in the arm 28 at the outer swing end thereof. This magnetic element 32 providing a forwardly directed contact face 34 positioned to contact the face 16 of the element 10 in magnetic latching relationship.

Positioned inwardly from the magnetic element 32 toward the axis of rotation of the pin 30, there is a forwardly protruding push element or surface 36 on the arm 28. In the configuration of this first embodiment, this push surface 36 is conveniently formed by the forward arm surface 37 adjacent the surface 34 of the magnetic element 32, meeting at an angle with the forward surface 38 of the arm 28 extending outwardly from the pivot axis 30. There is a spring 40 mounted in a coil about the bottom of the pivot pin 30. One end 42 of the spring 40 is anchored at the rearward side of the arm 28 at a location spaced moderately from its pivot axis, and the other end 44 of the spring 40 is anchored at an upstanding ear member 46 that is formed as an upward protrusion from the bracket 22. This ear member 46 serves the additional function of a stop member engaging the forward arm surface 38 so as to position the arm 28 in a forward latching position, shown in solid lines in FIG. 2. Thus the spring 40 is so arranged that it presses the arm 28 forwardly to its latching position in contact with the stop member 46.

In operation, the second latch member 18 is normally located in its forward position by the urging of the spring 40, with the contact surface 34 of the magnetic element 32 generally perpendicular to the path of travel of the door inwardly to the cupboard shelf 20. The first latching element 10 is likewise oriented so that its contact face 16 is aligned with the face 34 of the element 32 in its forward position so that when the door 14 is pushed closed with moderate force (so as not to deflect the arm 28 rearwardly to any great extent), the magnetic elements 10 and 32 come into magnetic latching relationship. In this closed position, the door 14 is spaced a very short distance forwardly of the cupboard structure (i.e. the shelf 20).

In the latching position shown in the solid lines of FIG. 2, the push element 36 of the arm 28 is positioned against the first element 10 at a location spaced inwardly toward the pivot axis 30 of the arm 28 from the magnetic element 32.

To open the door 14, the door 14 is pushed inwardly and abruptly released. This causes the door 14 to push against the push element 36 of the arm 28 and swing the arm 28 rearwardly to its unlatching position against the action of the spring 40. Since the push surface 36 is spaced inwardly from the magnetic element 32, the magnetic element 32 is caused to travel rearwardly a greater distance than the push surface 36, so that the magnetic element 32 moves out of magnetic latching engagement with the first member 10. Further, this inward push deforms the spring 40 to create a restoring force in this spring 40. When the pushing force on the door 14 is abruptly released, the spring 40 causes the arm 28 to move forwardly against the door to its forward position.

Of significance in the present invention is that the strength of the spring 40 is of a sufficient magnitude relative to the positioning of the push element 36 and also relative to the mutually magnetic attractive force between the magnetic elements 32 and 10, that sufficient momentum is imparted to the door 14 so that the momentum of the door 14 overcomes the attractive force between the magnetic elements 32 and 10, with the door continuing its outward motion to its open position.

A second embodiment of the present invention is illustrated in FIGS. 3 and 4. Those components of the second embodiment which are similar to those of the first embodiment will be given like numerical designations, with an *a* suffix distinguishing those of the second embodiment.

There is a first latch member **10*a* mounted to the cupboard door 14*a*, and a second latch member 18*a* comprising an arm 28*a* swing mounted by means of a pin 30*a* to a mounting bracket 22*a* fixedly attached to the shelf 20*a*. There is a magnetic element 32*a* and a push element 36*a* which are arranged in substantially the same manner as in the first embodiment. The second embodiment differs from the first embodiment primarily in the spring means which urges the arm 28*a*** to its forward latching position.

This modified spring means comprises a leaf spring 50, fixedly attached at its root end 52 to the back side of the arm **28*a* adjacent the location of the pivot pin 30*a*. From its root end 52, the leaf spring 50 extends forwardly and laterally in a direction opposite that of the arm 28*a* to terminate in a rearwardly curved end portion 54 which serves as a push element and is located in approximately the same transverse plane as the contact surface 34*a* of the magnetic element 32*a***.

In operation, when the door 14a is in its closed position, with the two members **10*a* and 18*a* in latching engagement, the outer push end 54 of the spring 50 is adjacent the door 14*a*. To open the door 14*a*, an inward push is exerted against the door 14*a*, with the result that the arm 28*a* is rotated counter clockwise, as viewed in FIG. 4, and the spring 50 is deflected in a clockwise direction. When the door 14*a* is abruptly released, both the spring push end 54 and the contact surface 36*a* of the arm 28*a* push against the door 14*a* to cause the door 14*a* to swing outwardly to its open position, with the arm 28***a* returning to its forward position. As in the prior embodiment, the momentum imparted to the door 14*a* is sufficient to overcome the magnetic force between the magnetic element 32*a* and the other magnetic element 10*a*. To properly position the arm 28*a*, there is provided a front stop member 46*a* and a rear stop member 56 behind the arm 28*a*.

A third embodiment of the present invention is shown in FIGS. 5 and 6. Components of this third embodiment which arc similar to those of the prior two embodiments will be given like numerical designations with a *b* suffix distinguishing those of the third embodiment.

As in the prior two embodiments there is a first magnetic latch member 10*b* mounted to a door 14*b* and a second magnetic latch member 18*b* comprising an arm 28*b* mounted by means of a pivot pin 30*b* to a bracket 22*b* which is in turn fixedly attached to a shelf 20*b*. The third embodiment is quite similar to the first embodiment, and differs primarily in the mounting of the arm 28*b*. The bracket 22*b* has an upstanding member 60 from which the pin 30*b* extends horizontally, rather than vertically, but still in a plane substantially perpendicular to the direction of movement of the door 14*b*. The lower front end of the bracket member 60 has a stop member 62 to prevent the arm 28*b* from moving beyond its forward direction. A spring member 40*b* is coiled around the pin 30*b* and anchored to the stop member 62 and to the arm 28*b*.

The mode of operation of the third embodiment is substantially the same as in the first embodiment. With the door 14*b* in its closed position, an inward push against the door 14*b* pushes the arm 28*b* rearwardly about its horizontal axis of rotation. When the door 14*b* is abruptly released, the push element 36*b* pushing against the door by virture of the spring 40*b* acting on the arm 28*b*, moves the door with sufficient momentum outwardly so that the door continues traveling to its open position, in opposition to the mutually attractive force of the magnetic members 32*b* and 10*b*.

Another facet of the present invention is illustrated in FIG. 7. While this particular feature is applicable to all three of the embodiments, it will be illustrated and described with reference to the particular configuration of the first embodiment shown in FIGS. 1 and 2. To distinguish the components shown in FIG. 7, those components which are similar to the components in the first embodiment will be given like numerical designations with a *c* suffix distinguishing those of the device of FIG. 7.

The arm 28*c* is mounted to the bracket 22*c* in the same manner as the first embodiment. However, the magnetic element 32*c* is mounted in a mating slot 70 in the arm 28*c*, in a manner that the lengthwise dimension of the slot 70 (indicated at *d* in FIG. 7) is moderately greater (i.e. about one-eighth of an inch longer) than the lengthwise dimension of that portion of the magnetic element 32*c* in the slot 70. Also, the lateral clearance of the slot 70 is sufficient to permit the magnetic element 32*c* to move backwards and forwards in the slot 70. A front peripheral lip or flange 72 retains the magnetic element 32*c* in its slot 70.

When the arm 28*c* is in its forward latching position, there is sufficient attraction between the magnetic element 32*c* and its matching magnetic element 10*c* that the magnetic element 32*c* is pulled to its forward position, as shown in FIG. 7, to be in close latching engagement with the element 10*c*. However, when the arm 28*c* is in its rearward non-latching position and begins its forward movement to push the door 14*c* away, the inertia of the magnetic element 32*c* will cause the element 32*c* to be positioned rearwardly in its slot 70 so that when in its pushing action the arm 28 reaches its forward position, the magnetic element 32*c* will still be spaced moderately from the element 10*c* to reduce the mutual magnetic attraction therebetween. The effect is that it is easier for the momentum of the door 14*c* to overcome the resisting magnetic force to permit the door 14*c* to continue to its open position.

What is claimed is:

1. In a push releasable magnetic latch assembly to latch a movable object to a stationary object, as in latching a door to a stationary structure, said objects being adapted to move relative to one another on a general path of travel toward each other and away from each other into, respectively, latching and unlatching positions, where the latch assembly comprises:

a first latch member mounted to one of said objects and comprising first magnetic means, a pivotal second latch member comprising an arm member and second magnetic means mounted thereto, said arm member being pivotally mounted to said other object for movement about an axis of rotation whereby said arm member is movable between a forward latching position with said first and second magnetic means being proximate one another in magnetic latching relationship and a rearward position with said first and second magnetic means spaced from one another to weaken the magnetic attraction therebetween and position the magnetic means in non-latching relationship, the improvement comprising in combination:

stop means on the same object as said rotatable second latch member for positioning said arm member in a forward position for accurately aligning the movable object in a closed position relative to the stationary object, push means on the arm member of the pivotal second latch member, said push means being spaced from said axis of rotation and positioned at a location which is between said axis of rotation and said second magnetic means and forwardly toward said first object, such that as said arm member swings between its forward and rearward positions, said push means engages said first object, such that said arm member is capable of acting as a lever arm against said first object, spring means operatively engaging said arm member to urge said arm member from its rearward position to its forward position against said stop means for repositioning the objects in a closed aligned position and for propelling the movable object away from the stationary object to overcome the weakened magnetic attraction of the first and second magnetic means when moving from said rearward position to said forward position such that the movable object swings open away from said stationary object.

2. The improvement as recited in claim 1, wherein there is a mounting bracket fixedly attached to said second object, with said arm member being mounted to said bracket, and said stop means being mounted to said bracket.

3. The improvement as recited in claim 1, wherein said push means comprises a forwardly protruding surface portion of said arm, formed by two forward surfaces of said arm member joining at an angle with respect to one another.

4. The improvement recited in claim 1, wherein said second magnetic means is mounted to said arm in a manner to permit limited forward and rearward motion of the second magnetic means, whereby when said arm moves from its rearward to its forward position, the inertia of said second magnetic means causes it to be positioned further rearwardly in said arm member, to reduce the magnetic attractive force between said first and second magnetic means.

5. The improvement as recited in claim 4, wherein said second magnetic means is mounted in slot means in said arm having a lengthwise dimension greater then that of the second magnetic means for providing forward and rearward movement of said second magnetic means relative to said arm.

6. In a push releasable magnetic latch assembly adapted to latch two objects, as in latching a door to a stationary structure, said objects being adapted to move relative to one another on a general path of travel toward each other and away from each other into, respectively, latching and unlatching positions, where the latch assembly comprises:

a. a first latch member mounted to one of said objects and comprising a first magnetic means, b. a second latch member comprising an arm member and a second magnetic means mounted thereto, said arm member being swing mounted to said other object for movement about an axis of rotation having a substantial vector component perpendicular to said path of travel, whereby said arm member is movable between a first forward latching position with said first and second magnetic means being proximate one another in magnetic latching relationship and a second rearward non-latching position with said first and second magnetic means spaced from one another in non-latching relationship, means spaced from one another in non-latching relationship, the improvement comprising in combination:

a. a push means on the arm member of the second latch member, said push means being spaced from said axis of rotation and positioned at a location which is between said axis of rotation and said second magnetic means and forwardly toward said first object, such that as said arm member swings between its first and second positions, said push means is capable of engaging said first object, such that said arm member is capable of acting as a lever arm against said first object, b. spring means operatively engaging said arm member to urge said arm member from its second rearward position to its forward position, the strength of said spring means being of a sufficient magnitude relative to the attractive force of said first and second magnetic means and relative to the length and position of application of the lever arm action of the arm member against said first object, that when said first and second objects are in latching position and one of said objects is pushed toward the other to force said second arm member to its second non-latching position, the force exerted by said spring means through its associated arm member to the first object imparts sufficient relative velocity to the moving object to overcome the attractive force of the two magnetic means so that the movable object continues to move to its unlatching position, wherein there is stop means positioned to engage said arm member at its forward position so as to limit further forward movement of said arm member, wherein there is a mounting bracket fixedly attached to said second object, with said arm member being mounted to said bracket, and said stop means being mounted to said bracket, and wherein said spring means has one end anchored to said stop member, and another end anchored to said arm.

7. In a push releasable magnetic latch assembly adapted to latch two objects, as in latching a door to a stationary structure, said objects being adapted to move relative to one another on a general path of travel toward each other and away from each other into, respectively, latching and unlatching positions, where the latch assembly comprises:

a. a first latch member mounted to one of said objects and comprising a first magnetic means, b. a second latch member comprising an arm member and a second magnetic means mounted thereto, said arm member being swing mounted to said other object for movement about an axis of rotation having a substantial vector component perpendicular to said path of travel, whereby said arm member is movable between a first forward latching position with said first and second magnetic means being proximate one another in magnetic latching relationship and a second rearward non-latching position with said first and second magnetic means spaced from one another in non-latching relationship, the improvement comprising in combination:

a. a push means on the arm member of the second latch member, said push means being spaced from said axis of rotation and positioned at a location which is between said axis of rotation and said second magnetic means and forwardly toward said first object, such that as said arm member swings between its first and second positions, said push means is capable of engaging said first object, such that said arm member is capable of acting as a lever arm against said first object, b. spring means operatively engaging said arm member to urge said arm member from its second rearward position to its forward position, the strength of said spring means being of a sufficient magnitude relative to the attractive force of said first and second magnetic means and relative to the length and position of application of the lever arm action of the arm member against said first object, that when said first and second objects are in latching position and one of said objects is pushed toward the other to force said second arm member to its second non-latching position, the force exerted by said spring means through its associated arm member to the first object imparts sufficient relative velocity to the moving object to overcome the attractive force of the two magnetic means so that the movable object continues to move to its unlatching position, wherein there is stop means positioned to engage said arm member at its forward position so as to limit further forward movement of said arm member, wherein there is a mounting bracket fixedly attached to said second object, with said arm member being mounted to said bracket, and said stop means being mounted to said bracket, and wherein said spring means comprises a coil spring mounted adjacent the axis of rotation of said arm, said coil spring having a first end anchored to stop means and a second end anchored to said bracket.

8. In a push releasable magnetic latch assembly adapted to latch two objects, as in latching a door to a stationary structure, said objects being adapted to move realtive to one another on a general path of travel toward each other and away from each other into, respectively, latching and unlatching positions, where the latch assembly comprises:

a. a first latch member mounted to one of said objects and comprising a first magnetic means, b. a second latch member comprising an arm member and a second magnetic means mounted thereto, said arm member being swing mounted to said other object for movement about an axis of rotation having a substantial vector component perpendicular to said path of travel, whereby said arm member is movable between a first forward latching position with said first and second magnetic means being proximate one another in magnetic latching relationship and a second rearward non-latching position with said first and second magnetic means spaced from one another in non-latching relationship, the improvement comprising in combination:

a. a push means on the arm member of the second latch member, said push means being spaced from said axis of rotation and positioned at a loctaion which is between said axis of rotation and said second magnetic means and forwardly toward said first object, such that as said arm member swings between its first and second positions, said push means is capable of engaging said first object, such that said arm member is capable of acting as a lever arm against said first object, b. spring means operatively engaging said arm member to urge said arm member from its second rearward position to its forward position, the strength of said spring means being of a sufficient magnitude relative to the attractive force of said first and second magnetic means and relative to the length and position of application of the lever arm action of the arm member against said first object, that when said first and second objects are in latching position and one of said objects is pushed toward the other to force said second arm member to its second non-latching position, the force exerted by said spring means through its associated arm member to the first object imparts sufficient relative velocity to the moving object to overcome the attractive force of the two magnetic means so that the movable object continues to move to its unlatching position, and wherein there are:

a. a generally plate-like mounting bracket mounted to said second object, b. a pivot pin connected to and extending from said bracket with its axis generally perpendicular to said path of travel of said objects toward each other, c. a stop member upturned from said bracket and positioned to engage said arm at its forward position to prevent further forward rotation of said arm, d. said spring means being a coil spring mounted to said pin, with one end of said coil spring anchored to said stop member, and the other end of said coil spring anchored to said arm.

9. In a push releasable magnetic latch assembly adapted to latch two objects, as in latching a door to a stationary structure, said objects being adapted to move relative to one another on a general path of travel toward each other and away from each other into, respectively, latching and unlatching positions, where the latch assembly comprises:

a. a first latch member mounted to one of said objects and comprising a first magnetic means, b. a second latch member comprising an arm member and a second magnetic means mounted thereto, said arm member being swing mounted to said other object for movement about an axis of rotation having a substantial vector component perpendicular to said path of travel, whereby said arm member is movable between a first forward latching position with said first and second magnetic means being proximate one another in magnetic latching relationship and a second rearward non-latching position with said first and second magnetic means spaced from one another in non-latching relationship, the improvement comprising in combination:

a. a push means on the arm member of the second latch member, said push means being spaced from said axis of rotation and positioned at a location which is between said axis of rotation and said second magnetic means and forwardly toward said first object, such that as said arm member swings between its first and second positions, said push means is capable of engaging said first object, such that said arm member is capable of acting as a lever arm against said first object, b. spring means operatively engaging said arm member to urge said arm member from its second rearward position to its forward position, the strength of said spring means being of a sufficient magnitude relative to the attractive force of said first and second magnetic means and relative to the length and position of application of the lever arm action of the arm member against said first object, that when said first and second objects are in latching position and one of said objects is pushed toward the other to force said second arm member to its second non-latching position, the force exerted by said spring means through its associated arm member to the first object imparts sufficient relative velocity to the moving object to overcome the attractive force of the two magnetic means so that the movable object continues to move to its unlatching position, and wherein said spring means comprises a leaf spring having a first end anchored to said arm member and a second end extending forwardly toward said first object, with the second end of said spring being arranged to engage said first object and be deflected thereby as said first object is moved toward said second object, with said leaf spring pushing from said first object to urge said arm forwardly against said first object.

10. The improvement as recited in claim 9, wherein said leaf spring is fixedly attached to said arm at a location adjacent said axis of rotation, and said leaf spring extends forwardly and laterally in a direction generally opposite to that in which the arm member extends from said leaf spring, whereby as said first object is moved against said arm member and said leaf spring, said arm member and said leaf spring are caused to rotate rearwardly in opposite directions from one another, with both said leaf spring and said arm exerting a forward force against said first object.

11. In a push releasable magnetic latch assembly adapted to latch two objects, as in latching a door to a stationary structure, said objects being adapted to move relative to one another on a general path of travel toward each other and away from each other into, respectively, latching and unlatching positions, where the latch assembly comprises:

a. a first latch member mounted to one of said objects and comprising a first magnetic means, b. a second latch member comprising an arm member and a second magnetic means mounted thereto, said arm member being swing mounted to said other object for movement about an axis of rotation having a substantial vector component perpendicular to said path of travel, whereby said arm member is movable between a first forward latching position with said first and second magnetic means being proximate one another in magnetic latching relationship and a second rearward non-latching position with said first and second magnetic means spaced from one another in non-latching relationship, the improvement comprising in combination:

a. a push means on the arm member of the second latch member, said push means being spaced from said axis of rotation and positioned at a location which is between said axis of rotation and said second magnetic means and forwardly toward said first object, such that as said arm member swings between its first and second positions, said push means is capable of engaging said first object, such that said arm member is capable of acting as a lever arm against said first object, b. spring means operatively engaging said arm member to urge said arm member from its second rearward position to its forward position, the strength of said spring means being of a sufficient magnitude relative to the attractive force of said first and second magnetic means and relative to the length and position of application of the lever arm action of the arm member against said first object, that when said first and second objects are in latching position and one of said objects is pushed toward the other to force said second arm member to its second non-latching position, the force exerted by said spring means through tis associated arm member to the first object imparts sufficient relative velocity to the moving object to overcome the attractive force of the two magnetic means so that the movable object continues to move to its unlatching position, and wherein there is a generally plate-like mounting bracket secured to one of said members, and a bracket member upstanding from the bracket, a pivot pin extending from said bracket member generally parallel to said plate-like bracket member, a coil spring mounted to said pin, with one end of said coil spring anchored to said arm and a second end of said coil spring anchored to said upstanding bracket member, and a stop member mounted to said upstanding bracket member.

12. The improvement as recited in claim 1, wherein said spring means includes a coiled wire spring wrapped around the pivot axis.

* * * * *